United States Patent [19]

Fausel

[11] Patent Number: 5,063,844

[45] Date of Patent: Nov. 12, 1991

[54] OFFSET ROTARY MACHINE WITH AT LEAST ONE PRINTING UNIT

[75] Inventor: Thomas E. Fausel, Ostfildern, Fed. Rep. of Germany

[73] Assignee: Simom S.A., Zug, Switzerland

[21] Appl. No.: 448,758

[22] Filed: Dec. 11, 1989

[30] Foreign Application Priority Data

May 27, 1989 [DE] Fed. Rep. of Germany ..... 3917340

[51] Int. Cl.[5] ..... B41F 13/24

[52] U.S. Cl. ..... 101/247; 101/148; 101/352

[58] Field of Search ..... 101/137, 138, 139, 140, 101/142, 143, 144, 145, 176, 182, 184, 185, 209, 217, 218, 219, 247, 248, 350, 351, 352

[56] References Cited

U.S. PATENT DOCUMENTS

| | | | |
|---|---|---|---|
| 4,370,926 | 2/1983 | Hattori | 101/209 |
| 4,385,559 | 5/1983 | Jarach | 101/352 |
| 4,458,591 | 7/1984 | Guaraldi | 101/352 |
| 4,567,827 | 2/1986 | Fadner | 101/141 |
| 4,573,407 | 3/1986 | Jeschke | 101/148 |
| 4,610,201 | 9/1986 | Jeschke | 101/217 |
| 4,621,575 | 11/1986 | Jeschke | 101/217 |
| 4,913,943 | 4/1990 | Goossen | 101/148 |
| 4,922,818 | 5/1990 | Junghans | 101/148 |

FOREIGN PATENT DOCUMENTS

| | | | |
|---|---|---|---|
| 61618 | 6/1982 | European Pat. Off. | 101/217 |
| 8410619 | 4/1984 | Fed. Rep. of Germany . | |
| 2064431 | 6/1981 | United Kingdom | 101/352 |

*Primary Examiner*—Edgar S. Burr
*Assistant Examiner*—Joseph R. Keating
*Attorney, Agent, or Firm*—Toren, McGeady & Associates

[57] ABSTRACT

An offset rotary machine including a printing unit with two plate cylinders which are arranged at a predetermined distance from each other. The two plate cylinders are mounted so as to be engageable and disengageable alternatingly against a rubber blanket cylinder and an inking mechanism. A single inking roller is pressed against the engaged plate cylinder. Only a single dampening roller of the dampening mechanism is pressed against the inking roller. The alternating engagement of the two plate cylinders makes it possible to carry out a flying plate exchange while maintaining the ink/water balance and, consequently, preventing a misprint until the ink/water balance has been reached. Moreover, an additional printing unit, inking mechanism and dampening mechanism is not necessary for the flying plate exchange.

12 Claims, 2 Drawing Sheets

OFFSET ROTARY MACHINE WITH AT LEAST ONE PRINTING UNIT

BACKGROUND OF THE INVENTION

1. Field of the Invention

The present invention relates to an offset rotary machine including at least one printing unit with plate cylinder, rubber blanket cylinder and impression cylinder, and an inking mechanism and a dampening mechanism for the plate cylinder. The offset rotary machine may also include a double printing unit in which the second rubber blanket cylinder acts as counter impression cylinder.

2. Description of the Related Art

Various types of offset rotary machines are known, particularly those with printing-on-the-fly printing units. In offset rotary machines which operate without interruption and, thus, at full printing speed, it is always a problem to be able to make a change to print different texts and illustrations, for example, for regional partial editions. For this purpose, all known offset rotary machines are equipped for each color with a second printing unit, inking mechanism and dampening mechanism which essentially form an exchange unit. As a result, it is possible to perform a plate exchange at the plate cylinder of the printing unit which stands still, while the other printing unit is running. When the entire partial edition has been reached in the running printing unit, the standing printing unit is accelerated to a speed which is synchronous with the speed of the running printing unit and is coupled into the running printing unit, while the printing unit which has been running up to now is uncoupled and decelerated and, after reaching standstill, is now itself ready for a plate exchange.

The exchange units described above render a printing plant cumbersome and expensive because they require doubling of printing unit, inking mechanism and dampening mechanism. This is because each printing unit requires its own inking mechanism and dampening mechanism. Thus, two printing units must be available when printing on one side and four such units are required when printing on two sides. In addition, the exchange unit must not only be accelerated until the synchronous speed is reached, but the necessary ink-/water equilibrium is not present during the startup; this ink/water equilibrium is absolutely necessary for a problem-free inking of the printing plate and, thus, for an excellent printed image. Experience has shown that this ink/water balance occurs only after a long startup period and can also not be controlled by proofing. Consequently, inferior paper web printed during the flying plate exchange must be expected and discarded as useless mackled paper. This reduces the productivity of the known offset rotary machines with exchange units.

It is, therefore, the primary object of the present invention to provide an offset rotary machine of the above-described type in which a flying plate exchange is possible with a printing unit of simple construction and which, moreover, can operate without startup difficulties and production losses with an always existing ink/water balance.

SUMMARY OF THE INVENTION

In accordance with the present invention, an offset rotary machine of the above-described type includes a printing unit with two plate cylinders which are arranged at a predetermined distance from each other.

The two plate cylinders are arranged so as to be engageable and disengageable on the same coordinate alternatingly against the rubber blanket cylinder and the inking mechanism. Only one inking roller of the inking mechanism presses against the plate cylinder which is engaged at a given time and only one dampening roller of the dampening mechanism presses against the inking roller, so that the dampening agent is directly transferred to the inking roller.

The present invention initially starts from the finding that a sufficient ink saturation or intensity and, thus, a problem-free printed image can be achieved even if the ink mechanism acts on the plate cylinder with only one inking roller, as long as roller diameter and roller quality are sufficient and a uniform ink distribution is ensured. The invention further starts from the finding that the dampening mechanism does not have to act directly on the plate cylinder; rather, the dampening mechanism can act indirectly through an inking roller and an excellent wetting of the plate cylinder or of the printing plate mounted on the cylinder can also be achieved if only one dampening roller wets the single inking roller and sufficient evaporation surfaces for the dampening agent are provided. Consequently, in accordance with the teaching of the present invention, it is possible to limit the exchange unit to only one plate cylinder.

Thus, while the engaged plate cylinder is rotating, the printing plate of the disengaged, uncoupled, and, thus, standing plate cylinder can be exchanged. After the desired partial edition has been reached, the standing and reequipped plate cylinder is accelerated to printing speed, is coupled and engaged and the plate cylinder which rotated up to then is disengaged, uncoupled and decelerated. The inking mechanism and the dampening mechanism are practically not affected by this flying plate exchange, so that start-up difficulties cannot occur and it is particularly ensured that the necessary ink/water balance always exists for a problem-free print reproduction.

The printing unit merely requires an additional plate cylinder with engaging and disengaging unit, coupling unit, accelerating and decelerating unit, so that, for printing on one side, the offset rotary machine merely requires a printing unit, an inking mechanism and a dampening mechanism.

For printing on both sides, another offset rotary machine according to the present invention is provided mirror-inverted relative to the paper web. The rubber blanket cylinder of this additional offset rotary machine simultaneously serves as the impression cylinder. Thus, for printing on the two sides, the offset rotary machine according to the present invention merely requires two additional plate cylinders and units for operating the two plate cylinders. The overall structural requirements of the plant are reduced and, moreover, a substantial production increase is achieved because the print reproduction is without problems from the beginning even after a flying plate exchange and, therefore, mackled paper does not have to be expected.

In accordance with another important feature of the present invention, the two plate cylinders are arranged with parallel axes and horizontally next to each other or vertically one above the other, wherein the common coordinate essentially extends parallel to the paper web. Preferably, the two plate cylinders can be engaged and disengaged synchronously, in order to minimize misprints during a flying plate exchange. The cylinders can be decelerated and accelerated to printing speed in the uncoupled state and can be connected to the drive by means of a one-to-one coupling.

The plate cylinders may be coupled mechanically to each other for synchronously engaging and disengaging the plate cylinders. Each of the two plate cylinders advantageously has a drawing-in or tightening device, for example, a passing-in roller for positively inserting the printing plate to be exchanged. Accordingly, any contact of the printing plate to be introduced with the rotating inking roller and the rotating rubber blanket cylinder is prevented with certainty.

In accordance with another recommended feature, the inking roller for the two plate cylinders is mounted in front of the cylinder gap formed by the two plate cylinders and centrally on the same coordinate as the rubber blanket cylinder and the inking roller is adjustable on this coordinate relative to the engaged plate cylinder or the cylinder gap. This coordinate extends essentially perpendicularly to the paper web or impression points. The axis-parallel and aligned arrangement of rubber blanket cylinder and inking roller ensures an always uniform contact pressure on the engaged plate cylinder.

In accordance with a particularly important feature of the invention, the inking roller has a diameter or circumference which is at least half the size of the diameter or circumference of the plate cylinder. The inking roller has as its shell a soft Shore covering with a Shore hardness of 25 to 30 Shore. Thus, the inking roller has a diameter and a circumference of a size which ensure a positive ink application. Accordingly, a good print reproduction is achieved requiring only moderate contact pressure and using only a single inking roller because the soft roller shell ensures a flat surface-like contact of the inking roller on the engaged plate cylinder. This type of contact effects the ink transfer required for the desired ink intensity of the printed image.

The invention further provides that the dampening roller pressed against the inking roller is mounted so as to be pivotable or retractable. As a result, the inking roller can be easily assembled and disassembled or a roller exchange can be carried out without requiring disassembly of the dampening mechanism. Since the inking roller itself is adjustable, the two plate cylinders can be assembled and disassembled or exchanged without requiring a disassembly of the inking mechanism and the dampening mechanism. Moreover, the possibility of adjusting the inking roller makes it possible to adjust the contact pressure against the engaged plate cylinder. The other rollers of the inking mechanism follow the adjustment of the inking roller.

A uniform application of the ink is achieved by providing a laterally reciprocating rider roller which is arranged on the first brayer or on the inking roller. With its lateral reciprocating movement, the rider roller wipes away the traces of the preceding ink application and, thus, removes the known stencil effect. This rider roller may also be a screen roller which has surfaces which are simultaneously compatible with water and ink. The materials which can be used for this purpose are the combinations chromium/copper and chromium/11-polyamide. The properties of the rider roller result in an improved evaporation effect and prevent excessive emulsification of the ink film in the inking mechanism.

In accordance with a preferred embodiment of the invention, only a single inking roller is provided. However, it is also possible within the scope of the invention to provide two coupled inking rollers which can be pivoted and adjusted together. The dampening mechanism may then be an alcohol mechanism or a conventional dampening mechanism.

The inking mechanism may be a lifting mechanism or a film-type inking mechanism. The inking mechanism may have a short or a long structural length.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
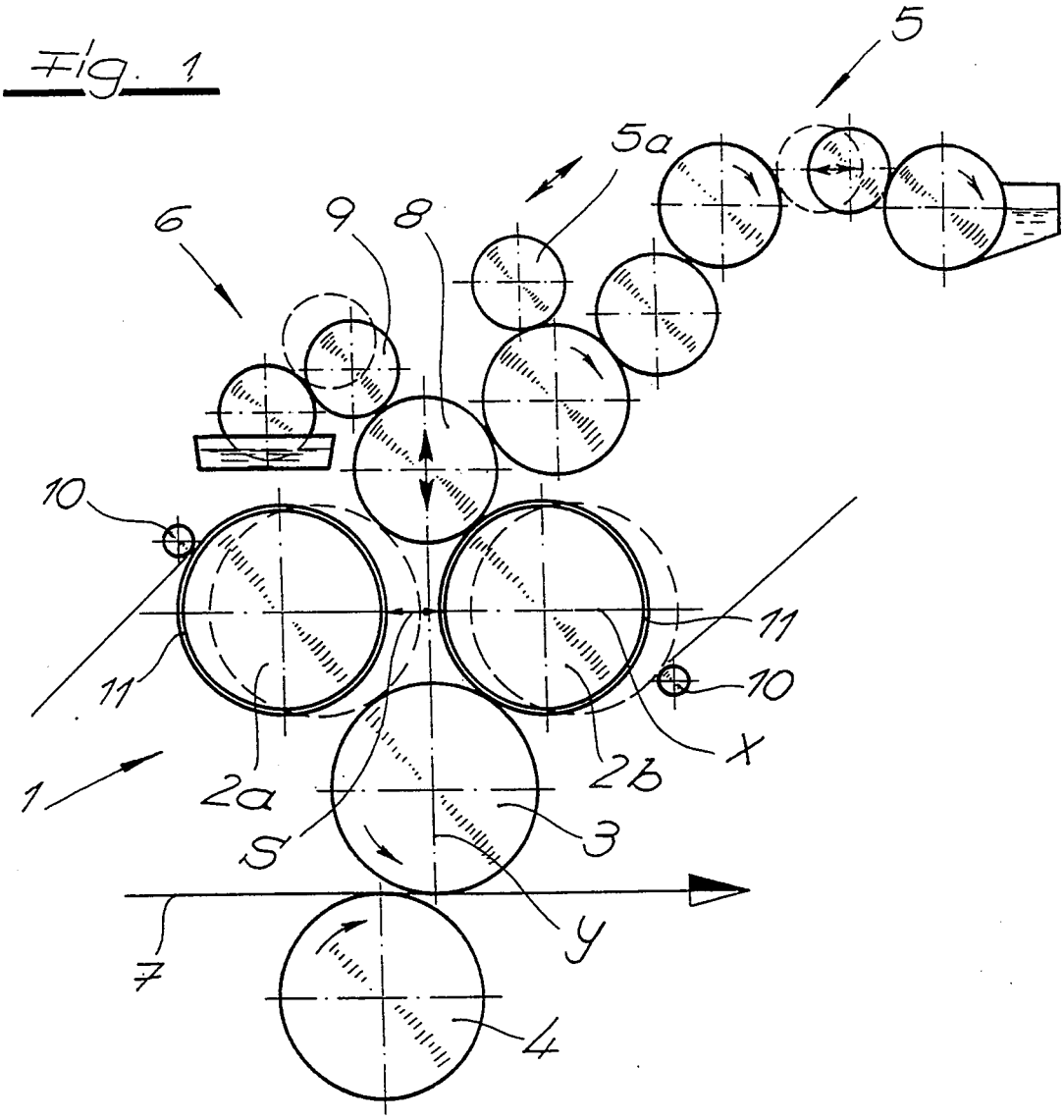
Fig. 1 is a schematic sectional view of an offset rotary machine according to the present invention for printing on one side.

As illustrated in Fig. 1 of the drawing, an offset rotary machine according to the present invention includes a printing unit 1 with plate cylinder 2*a*, rubber blanket cylinder 3 and impression cylinder 4, and with an inking mechanism 5, a rider roller 5*a* and a dampening mechanism 6 for the plate cylinder 2*a* for printing on one side.

Figure 2:
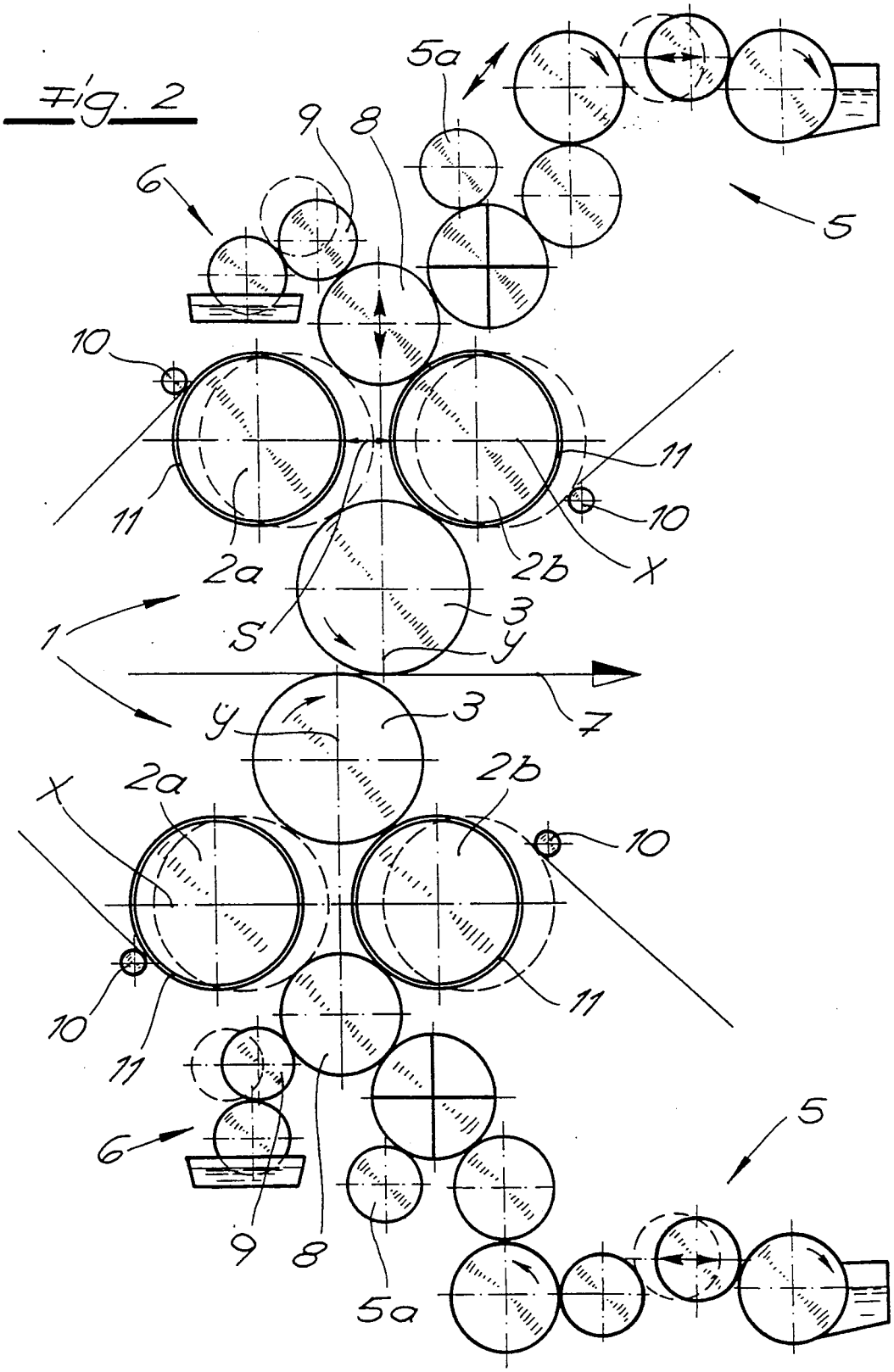
FIG. 2 is a schematic sectional view of an offset rotary machine according to the present invention for printing on two sides.

FIG. 2 of the drawing shows another embodiment for printing on two sides which includes another printing unit 1 with inking mechanism 5 and dampening mechanism 6, wherein the impression cylinder is formed by a rubber blanket cylinder 3.

For multicolor printing on one side or on both sides, a plurality of such offset rotary machines are arranged one behind the other, wherein the number of machines corresponds to the number of colors. The paper web 7 to be printed is conducted between the rubber blanket cylinder 3 and the impression cylinder 4, as shown in FIG. 1, or between the two rubber blanket cylinders 3, as shown in FIG. 2. Instead of the vertical arrangement of the printing units, a horizontal arrangement can also be realized.

The printing unit 1 always has two plate cylinders 2*a*, 2*b* which are arranged at a predetermined distance from each other. The two plate cylinders 2*a*, 2*b* can be engaged and disengaged alternatingly on the same coordinate X against the rubber blanket cylinder 3 and the inking mechanism 5, as indicated in broken lines. The inking mechanism includes a rider roller 5*a* which, as indicated by a double arrow, is mounted so as to laterally reciprocate. A single inking roller 8 of the inking mechanism 5 presses against the engaged plate cylinder 2*a* or 2*b*. Only a single dampening roller 9 of the dampening mechanism 6 presses against the single inking roller 8.

The two plate cylinders 2*a*, 2*b* are arranged so that the axes thereof extend parallel to each other. As illustrated in the drawing, the two plate cylinders 2*a*, 2*b* are arranged horizontally next to each other. However, they can also be arranged vertically one above the other. They can be synchronously engaged and disengaged. Each of the two plate cylinders 2*a*, 2*b* is provided with a passing-in roller 10 for the positive insertion of the printing plate 11. The inking roller 8 provided for both plate cylinders 2*a*, 2*b* is arranged in front of the cylinder gap S by the two plate cylinders and on the same coordinate Y as the rubber blanket cylinders 3. The inking roller 8 is adjustable on this coordinate Y relative to the engaged plate cylinder 2*a* or 2*b* or relative to the cylinder gap S. This is also indicated by a double arrow. The common coordinate X of the two plate cylinders 2*a*, 2*b* extends parallel to the paper web 7 and the common coordinate Y for the rubber blanket cylinder 3 and the inking roller 8 extends perpendicularly to the paper web 7.

The inking roller 8 has a diameter or circumference which is at least half that of the diameter or circumference of the respective plate cylinder 2*a*, 2*b*. The inking roller 8 has a shell in the form of a soft Shore covering having a Shore hardness of 25 to 30 Shore, so that a flat surface-like contact with the engaged plate cylinder 2*a*, 2*b* is achieved for obtaining sufficient ink transfer. The dampening roller 9 pressing against the inking roller 8 is mounted, as also shown in broken lines, so as to be pivotable or retractable.

The above-described embodiments of the present invention make it immediately clear that, for a flying plate exchange, it is merely necessary to engage or disengage, couple, accelerate and decelerate the respective plate cylinders 2*a* and 2*b* and that the offset rotary machine only needs one printing unit 1, inking mechanism 5 and dampening mechanism 6.

While specific embodiments of the invention have been shown and described in detail to illustrate the application of the inventive principles, it will be understood that the invention may be embodied otherwise without departing from such principles.

I claim:

1. In an offset rotary machine including at least one printing unit with a plate cylinder, a rubber blanket cylinder and an impression cylinder, and an inking mechanism and a dampening mechanism for the plate cylinder, the printing unit including first and second plate cylinders arranged at a predetermined distance from each other, means for moving the first and second plate cylinders on a common coordinate between a first position and a second position, the inking mechanism including an inking roller, the first plate cylinder being in contact with the rubber blanket cylinder and the inking roller when the plate cylinders are in the first position and the second plate cylinder being in contact with the rubber blanket cylinder and the inking roller when the plate cylinders are in the second position, the improvement comprising the dampening mechanism including a dampening roller, the dampening roller being in direct contact with the inking roller, wherein a cylinder gap is defined between the two plate cylinders, further comprising means for adjusting the inking roller relative to the cylinder gap between the plate cylinders.

2. The offset rotary machine according to claim 1, comprising means for synchronously moving the two plate cylinders between the first and second positions thereof.

3. The offset rotary machine according to claim 1, comprising for each plate cylinder a drawing-in device for positively mounting a printing plate on the plate cylinder.

4. The offset rotary machine according to claim 3, wherein the drawing-in device is a passing-in roller.

5. The offset rotary machine according to claim 1, wherein the inking roller and each plate cylinder has a diameter, the diameter of the inking roller being at least half the diameter of each plate cylinder, the inking roller having a roller shell of a soft Shore covering having a Shore hardness of 25 to 30 Shore.

6. The offset rotary machine according to claim 1, wherein the inking mechanism includes a rider roller and means for laterally moving the rider roller.

7. The offset rotary machine according to claim 6, wherein the rider roller acts on the inking roller.

8. The offset rotary machine according to claim 1, comprising means for pivoting the dampening roller away from the inking roller.

9. The offset rotary machine according to claim 1, wherein the dampening mechanism is an alcohol mechanism.

10. The offset rotary machine according to claim 1, wherein the dampening mechanism is a conventional water mechanism.

11. The offset rotary machine according to claim 1, wherein the inking mechanism is of short structural length.

12. The offset rotary machine according to claim 1, wherein the inking mechanism is of large structural length.

* * * * *